US008844606B2

(12) United States Patent
Dubuc et al.

(10) Patent No.: US 8,844,606 B2
(45) Date of Patent: Sep. 30, 2014

(54) METHOD AND APPARATUS FOR MACHINING MOLDING ELEMENTS FOR FOUNDRY CASTING OPERATIONS

(75) Inventors: Philippe Dubuc, Saint-Honore (CA); Marc Savard, Chicoutimi (CA)

(73) Assignee: Nopatech Inc., Saguenay (CA)

( * ) Notice: Subject to any disclaimer, the term of this patent is extended or adjusted under 35 U.S.C. 154(b) by 0 days.

(21) Appl. No.: 13/879,324

(22) PCT Filed: Oct. 11, 2011

(86) PCT No.: PCT/CA2011/001149

§ 371 (c)(1),
(2), (4) Date: Jun. 6, 2013

(87) PCT Pub. No.: WO2012/048413

PCT Pub. Date: Apr. 19, 2012

(65) Prior Publication Data

US 2013/0264021 A1 Oct. 10, 2013

Related U.S. Application Data

(60) Provisional application No. 61/392,061, filed on Oct. 12, 2010.

(51) Int. Cl.

| | |
|---|---|
| ***B22C 9/02*** | (2006.01) |
| ***B22C 9/10*** | (2006.01) |
| ***B22C 9/08*** | (2006.01) |

(52) U.S. Cl.

CPC ... *B22C 9/02* (2013.01); *B22C 9/08* (2013.01); *B22C 9/088* (2013.01); *B22C 9/10* (2013.01)

USPC ..... 164/137; 164/359; 164/360; 164/17; 164/23

(58) Field of Classification Search

CPC ..... B22C 9/02; B22C 9/08; B22C 9/088

USPC ..... 164/23, 24, 137, 359, 360

See application file for complete search history.

(56) References Cited

U.S. PATENT DOCUMENTS 3,387,645 A * 6/1968 Van Beckhoven ..... 164/17
3,498,366 A 3/1970 Merrick et al.

(Continued)

FOREIGN PATENT DOCUMENTS

CA 1011083 A1 5/1977
WO WO-00/27562 A1 5/2000

*Primary Examiner* — Keith Walker
*Assistant Examiner* — Kevin E Yoon
(74) *Attorney, Agent, or Firm* — Marshall, Gerstein & Borun LLP

(57) ABSTRACT

A method for machining a sand molding element, comprising: inserting at least one hollow center body having an internal cavity in a predetermined position in a casting flask; filling the internal cavity of the hollow center body with unbonded sand; filling the casting flask with bonded sand to obtain a sand block; machining a mold cavity in the sand block; and emptying the internal cavity from the unbounded sand. There is also provided a method for machining a molding core from a sand block, comprising: providing a core base member having a concave upper surface; forming a sand block on the core base member with a lower surface of the sand block resting on the concave upper surface; and machining the molding core into the sand block, the molding core having a convex lower surface complementary to the concave upper surface of the core base member.

24 Claims, 9 Drawing Sheets

(56) References Cited

U.S. PATENT DOCUMENTS

| | | | | |
|---|---|---|---|---|
| 4,104,347 | A * | 8/1978 | Ohashi et al. | 264/113 |
| 4,574,869 | A | 3/1986 | Trinkl et al. | |
| 4,804,032 | A | 2/1989 | Wilkins | |
| 5,462,106 | A * | 10/1995 | Hanna | 164/15 |
| 5,915,450 | A | 6/1999 | Aufderheide et al. | |
| 6,189,599 | B1 * | 2/2001 | Hanna | 164/37 |
| 6,386,264 | B2 | 5/2002 | Gustafson | |

* cited by examiner

METHOD AND APPARATUS FOR MACHINING MOLDING ELEMENTS FOR FOUNDRY CASTING OPERATIONS

CROSS-REFERENCE TO RELATED APPLICATIONS

This application claims priority under 35USC §119(e) of US provisional patent application 61/392,061 filed on Oct. 12, 2010, the specification of which is hereby incorporated by reference. This application is a national phase entry of PCT patent application Ser. No. PCT/CA2011/001149 filed on Oct. 11, 2011, now pending, designating the United States of America.

TECHNICAL FIELD OF THE INVENTION

The technical field relates to a method and an apparatus for machining molding elements for foundry casting operations and, more particularly it relates to a method and an apparatus for forming molding elements including cores, copes, drags, and other molding elements used in foundry casting operations.

BACKGROUND

Sand molds typically include an upper shell and a lower shell, often referred to as a cope and a drag. When juxtaposed, the cope and the drag define a hollow internal compartment therebetween having the external shape of the desired casting. If the casting includes an internal cavity, the sand mold further includes a core insertable in a predetermined position in the hollow internal compartment and which defines the internal cavity shape during casting. After the casting has solidified, the molding elements including the cope, the drag, and the internal core(s) are destroyed at shake out.

Preparing the molding elements is a time consuming task. It requires precision to ensure that the resulting casting is near its final shape. There is thus always a need to accelerate the turnaround time in the casting industry without losing precision in the resulting castings.

BRIEF SUMMARY OF THE INVENTION

It is therefore an aim of the present invention to address the above mentioned issues.

According to a general aspect, there is provided a method for forming a sand molding element, comprising: inserting at least one hollow center body having an internal cavity in a predetermined position in a casting flask, the internal cavity being filled with unbonded sand; filling the casting flask with bonded sand to obtain a sand block; and substantially emptying the internal cavity of the at least one hollow center body from unbonded sand.

According to another general aspect, there is provided a method for machining a sand molding core from a sand block, comprising: providing a core base member having a concave upper surface; forming a sand block on the core base member with a lower surface of the sand block resting on the concave upper surface; and machining the molding core into the sand block, the molding core having a convex lower surface complementary to the concave upper surface of the core base member.

According to another general aspect, there is provided a method for forming a molding element, comprising: inserting at least one hollow center body defining an internal cavity in a predetermined position in a casting flask, the internal cavity being filled with granular material; filling the casting flask with bonded granular material to obtain a granular material block; and substantially emptying the internal cavity of the at least one hollow center body from the granular material.

According to an embodiment, the method above comprises filling the internal cavity of the hollow center body with the granular material following the insertion of the at least one hollow center body in the casting flask.

According to an embodiment, the method above comprises machining a mold cavity in a top side of the granular material block.

According to an embodiment of the method above, the machining is carried prior to said emptying the internal cavity and said substantially emptying comprises emptying the internal cavity through the mold cavity.

According to an embodiment of the method above, the machining is carried following said emptying the internal cavity.

According to an embodiment of the method above, the machining comprises maintaining the granular material block remains in a stationary configuration.

According to an embodiment of the method above, the granular material block comprises a bottom side, opposed to the top side, wherein the mold cavity comprises a recess defined in the top side of the granular material block and the at least one hollow center body is positioned close to the bottom side of the granular material block and the internal cavity is in fluid communication with the mold cavity.

According to an embodiment of the method above, the internal cavity has an internal cavity volume and the mold cavity has a mold cavity volume, the internal cavity volume being smaller than the mold cavity volume.

According to an embodiment, the method above comprises a first layer of bonded granular material in the casting flask before inserting the at least one hollow center body in the casting flask and wherein said inserting comprises positioning the at least one hollow center body on the first layer of the bonded granular material.

According to an embodiment of the method above, the inserting comprises positioning the at least one hollow center body directly on a molding board and said emptying comprises emptying the internal cavity through an open end of the at least one hollow center body aligned with a bottom side of the granular material block.

According to an embodiment of the method above, the internal cavity defines a riser of the molding element.

According to an embodiment of the method above, the at least one hollow center body comprises a rigid tubular shell and the internal cavity is open at both ends. The rigid tubular shell can comprise a ceramic fiber sleeve. The rigid tubular shell can comprise a heat insulating material.

According to an embodiment of the method above, the granular material of the internal cavity comprises unbonded sand and the bonded granular material comprises bonded sand.

According to another general aspect, there is provided a molding element comprising: an aggregate material body having a top side, a bottom side, opposed to the top side, and a mold cavity defining a recess in the top side; and at least one hollow center body embedded in the aggregate material body in a predetermined position and defining an internal cavity in fluid communication with the mold cavity.

According to an embodiment of the molding element above, the internal cavity is filled with flowable granular material.

According to an embodiment of the molding element above, the aggregate material body comprises bonded sand and the flowable granular material comprises unbonded sand.

According to an embodiment, the molding element above comprises a casting flask surrounding the aggregate material body.

According to an embodiment of the molding element above, the internal cavity has an internal cavity volume and the mold cavity has a mold cavity volume, the internal cavity volume being smaller than the mold cavity volume.

According to an embodiment of the molding element above, the at least one hollow center body comprises a rigid tubular shell and the internal cavity is open at both ends and one of the open ends of the internal cavity is exposed on the bottom side of the aggregate material body.

According to an embodiment of the molding element above, the at least one hollow center body comprises a rigid tubular shell and the internal cavity is open at both ends and one of the open end is covered by a layer of the aggregate material body.

According to an embodiment of the molding element above, the rigid tubular shell comprises a ceramic fiber sleeve.

In an embodiment, the rigid tubular shell comprises a heat insulating material.

According to an embodiment of the molding element above, the internal cavity defines a riser of the molding element.

According to another general aspect, there is provided a method for machining a molding core from an aggregate material block, comprising: providing a core base member having a concave surface; forming the aggregate material block on the core base member with a surface of the aggregate material block resting on the concave surface of the core base member; and machining the molding core in the aggregate material block, the molding core having a first convex surface complementary to the concave surface of the core base member.

According to an embodiment of the method above, the step of providing the core base member comprises filling a casting flask having a concave profile with granular material.

According to an embodiment of the method above, the concave surface of the core base member has a V-shaped profile.

According to an embodiment of the method above, the core base member comprises two inwardly inclined surfaces defining the concave surface.

According to an embodiment of the method above, the inwardly inclined surfaces are substantially flat surfaces and meet at a contact edge.

According to an embodiment of the method above, the first convex surface of the molding core is part of a core print.

According to an embodiment of the method above, the machining comprises machining a second convex surface of the molding core in the aggregate material block, wherein the second convex surface is part of a core print.

According to an embodiment of the method above, each one of the first convex surface and the second convex surface comprises two inclined substantially flat surfaces meeting at a contact edge.

According to an embodiment of the method above, the contact edge extends lengthwise of the two surfaces.

According to an embodiment of the method above, the machining step comprises rotating the aggregate material block during said machining.

According to an embodiment of the method above, the rotating step comprises rotating continuously the aggregate material block during said machining.

According to an embodiment, the method above comprises securing positioning the aggregate material block to the core base member with retaining pins.

According to another general aspect, there is provided a core forming base for foundry casting operations, comprising: a core base member having a concave surface for forming a core aggregate material block thereon.

According to an embodiment, the core forming base above comprises a casting flask having a concave upper profile surrounding the core base member.

According to an embodiment of the core forming base above, the core base member comprises at least a granular material layer defining the concave surface.

According to an embodiment of the core forming base above, the concave surface of the core base member has a V-shaped profile.

According to an embodiment of the core forming base above, the core base member comprises two inwardly inclined surfaces defining the concave surface.

According to an embodiment of the core forming base above, the inwardly inclined surfaces are substantially flat surfaces and meet at a contact edge.

According to an embodiment, the core forming base above comprises a rotatable base and wherein the core base member is mounted to the rotatable base and rotates therewith.

According to another general aspect, there is provided a method for forming a casting mold including a molding core, comprising: providing at least one molding element having a mold cavity with at least one core-print pocket defined in a top side of the molding element; forming the molding core having at least one convex shaped core print; and inserting the molding core in the mold cavity with the at least one convex shaped core print engaged in a respective one of the at least one core-print pocket.

According to an embodiment of the method above, the at least one convex shaped core print comprises two inclined surfaces meeting at a contact edge and wherein the contact edge of the at least one convex shaped core print is substantially aligned with a top side of the at least one molding element in which the molding core is inserted.

According to an embodiment of the method above, two molding elements with complementary mold cavities are provided and the two molding elements are juxtaposed with the molding core inserted therebetween with the contact edge of the at least one convex shaped core print substantially aligned with the top sides of the two molding elements.

According to an embodiment of the method above, the molding core comprises at least two convex shaped core prints.

According to an embodiment of the method above, the forming comprises: providing a core base member having a concave surface; forming the aggregate material block on the core base member with a surface of the aggregate material block resting on the concave surface of the core base member; and machining a molding core in the aggregate material block, the molding core having a first convex shaped surface complementary to the concave surface of the core base member, the first convex shaped surface corresponding to one of the at least one convex shaped core print.

According to an embodiment of the method above, the core base member comprises two inwardly inclined surfaces defining the concave surface.

According to an embodiment of the method above, the machining comprises machining a second convex surface in the aggregate material block and wherein the second convex surface is part of a core print.

According to an embodiment of the method above, the machining step comprises rotating the aggregate material block during said machining.

According to an embodiment of the method above, the rotating step comprises rotating continuously the aggregate material block during said machining.

According to a general aspect, there is provided a foundry casting core comprising: a core body having at least one convex shaped core print.

According to an embodiment of the foundry casting core above, the aggregate material body comprises at least two convex shaped core prints.

According to an embodiment of the foundry casting core above, the at least one convex shaped core print comprises two inclined surfaces meeting at a contact edge.

According to an embodiment of the foundry casting core above, the core body comprises bonded sand.

According to another general aspect, there is provided a method for machining a molding core from an aggregate material block, comprising: positioning the aggregate material block on a rotative base member; and rotating the base member and simultaneously machining the aggregate material block into the molding core.

According to an embodiment of the method above, the base member is rotated continuously.

According to an embodiment of the method above, the machining step is performed by at least one stationary robot carrying at least one machining tool on a manipulated arm.

According to an embodiment of the method above, the base member performs at least one 360° rotation. In an embodiment, the base member performs one 360° rotation. According to an embodiment of the method above, the base member performs more than one 360° rotation.

BRIEF DESCRIPTION OF THE DRAWINGS

It will be noted that throughout the appended drawings, like features are identified by like reference numerals.

DETAILED DESCRIPTION

Figure 1:
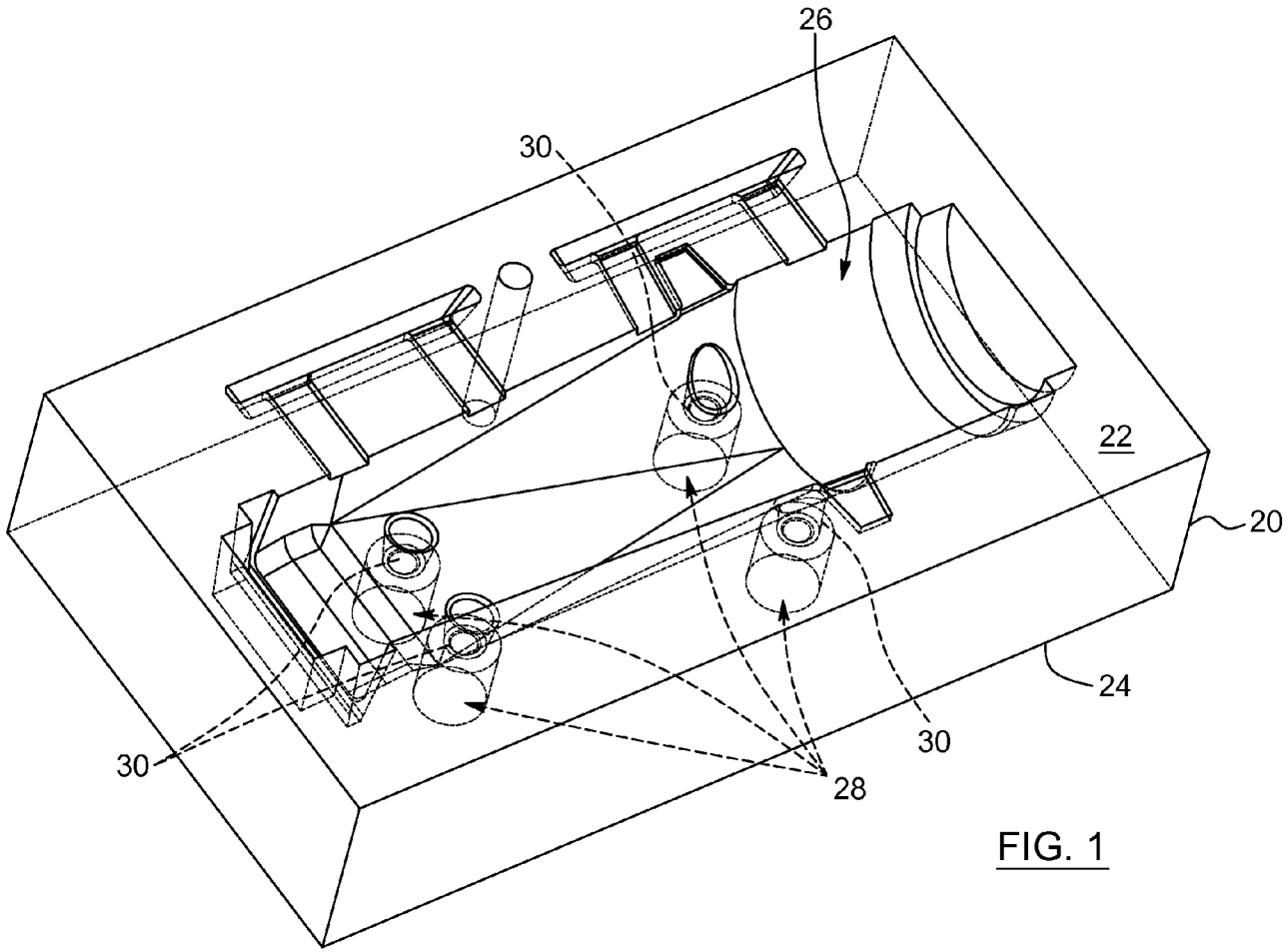
FIG. 1 is a schematic perspective view of a molding element in accordance with an embodiment.

Referring now to the drawings, methods and apparatuses for forming molding elements for foundry casting operations will be described. The molding elements are typically made from aggregate materials such as and without being limitative foundry sands.

Figure 2:
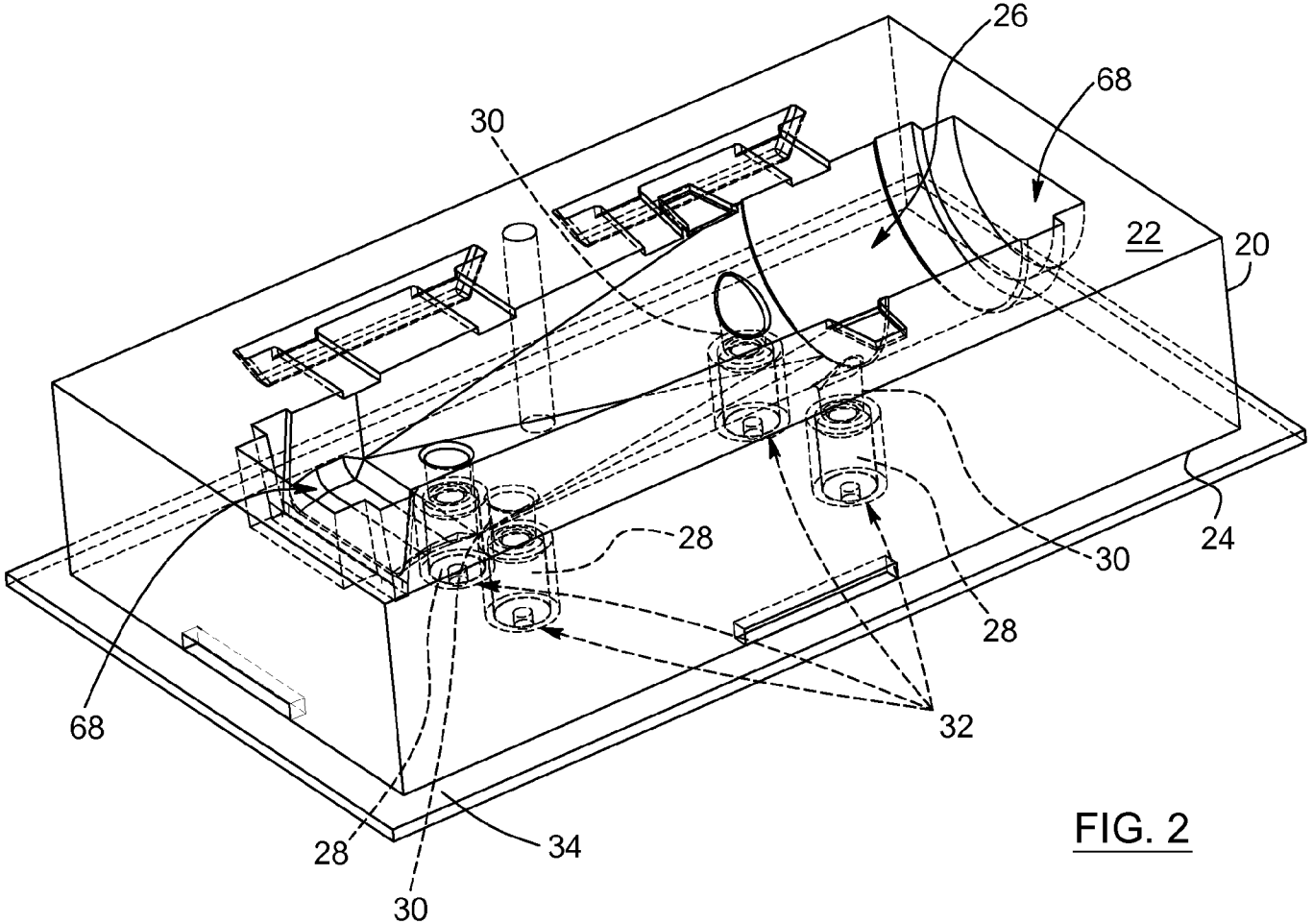
FIG. 2 is another schematic perspective view of the molding element shown in FIG. 1.

Referring now to FIGS. 1 and 2, there is shown a molding element 20, which can either be a cope or a drag, having a top side 22 and an opposed bottom side 24. A mold cavity 26, i.e. a recess, is formed in the top side 22 of the molding element 20. The mold cavity 26, or pattern cavity, is a portion of a hollow internal compartment defined in the resulting casting mold, i.e. when at least two molding elements are juxtaposed with their top sides in contact to define the hollow internal compartment. The hollow internal compartment will be poured with molten metal to obtain the resulting casting. In conventional sand molded casting processes, the mold cavity is created with a pattern, which is a replica of the object to be cast.

It is appreciated that the shape of the molding element 20 and the mold cavity 26 in FIGS. 1 and 2 are exemplary only and can differ from the embodiment shown in the accompanying drawings. Furthermore, in an alternative embodiment (not shown), the molding element can include more than one mold cavity.

In the embodiment shown, the molding element 20 is made from a sand block 36 (FIG. 3) formed with conventional foundry (casting) sand material held together by conventional binder material. Molding elements can be made from for example and without being limitative, green sand, hot box, oil bounded sand, furan, (no bake) shell, cold box, sodium silicate $CO_2$, and others as appropriate. One skilled in the art will appreciate that other aggregate or granular materials can be used.

Figure 3:
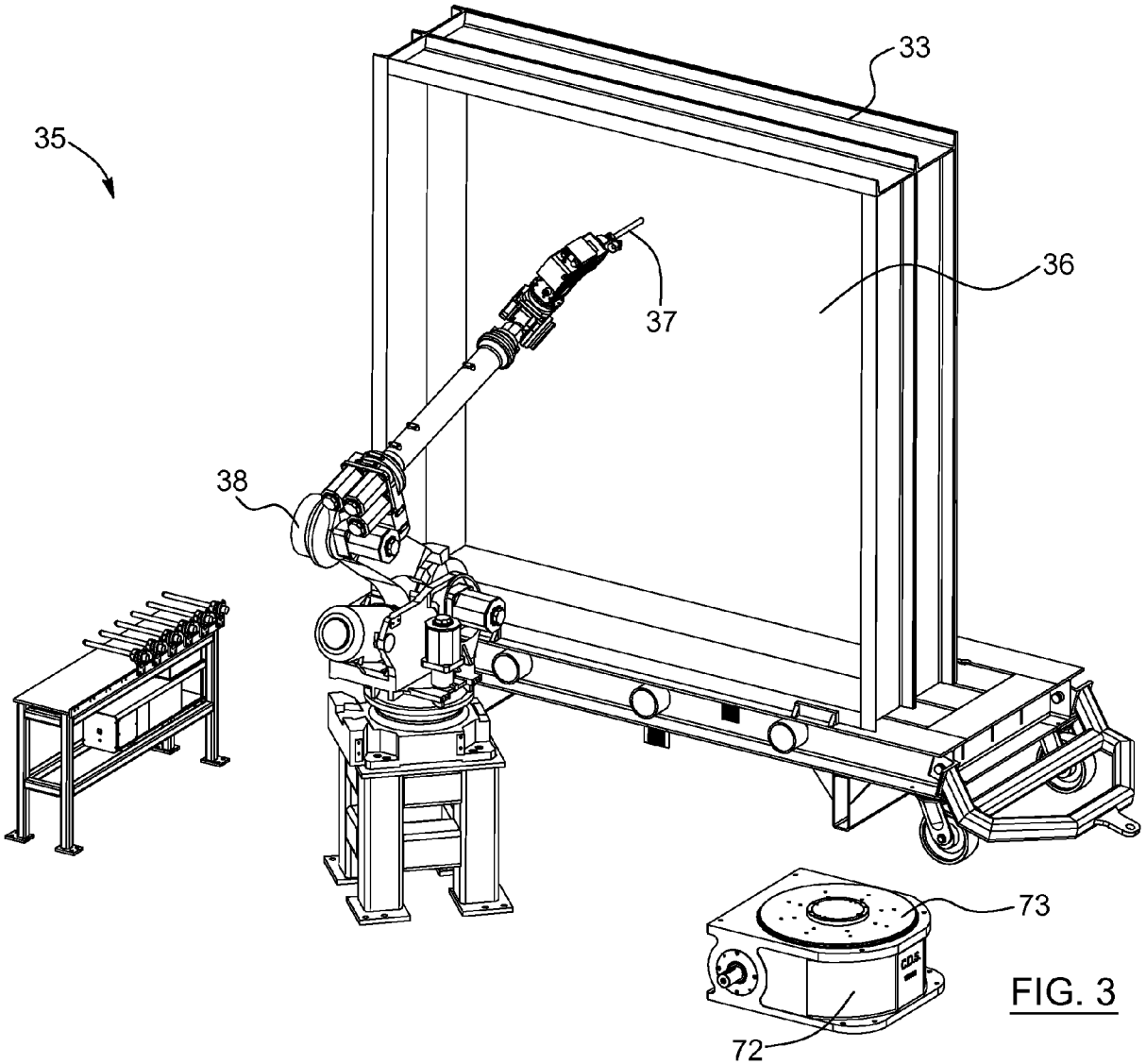
FIG. 3 is a schematic perspective view of a work cell in accordance with an embodiment.

Referring now to FIG. 3, there is shown an embodiment of a work cell 35 for machining molding elements. For machining the mold cavity 26 in the sand block 36, a cutting tool 37 mounted on a machine tool 38 such as a robot is used. In the embodiment shown, the cutting tool 37 is mounted on a manipulated arm of a robot 38. Typically, the top side 22 of the sand block 36 is facing the cutting bit of the machine tool. The sand block 36 is secured in a predetermined position and the cutting tool cuts into the top side 22 of the sand block 36 to remove material therefrom and begins to form the mold cavity 26 of the molding element 20. It is appreciated that several cutting bits can be used for defining the mold cavity 26.

The machine tool can be computer numerically controlled (CNC) driven, such that the tool is automatically driven based on computer-aided design (CAD) or other computer readable drawing files. In the embodiment shown in FIG. 3, the machine tool is a robot with an appropriate cutting head. For instance, once the CAD is completed, a computer-aided manufacturing (CAM) step can be performed. The CAM uses computer software to control one or several machine tools in the manufacturing of the molding element. The robot can also be programmed by a postprocessor computer software that converts the CAM computer software outputs into robot motion codes.

To save time and maintain a high precision when machining the molding element 20, the molding element 20 should be maintained in a single, predetermined, and stationary configuration. However, often shapes, cavities or forms cannot be machined directly from the top side 22 of the sand block 36. For instance and without being limitative, in the embodiment shown, the molding element 20 includes four risers 28 shown in FIGS. 1 and 2, which are located below the main mold cavity 26, close to the bottom side 24 of the molding element 20 and opposed to the top side 22. The risers 28 are connected to the mold cavity 26 through runners 30. Thus, the risers 28 are in fluid communication with the mold cavity 26 through runners 30. The risers 28 cannot be machined by conventional manufacturing methods without either the molding element 20 or the machine tool 38 and machining the risers 28 through the bottom side 24 of the molding element 20 since they are located close to the bottom side 24 of the molding element 20. However, as mentioned above, displacing the molding element 20 during the machining step increases the manufacturing time and lowers the resulting precision of the features of the molding element 20.

Figure 4:
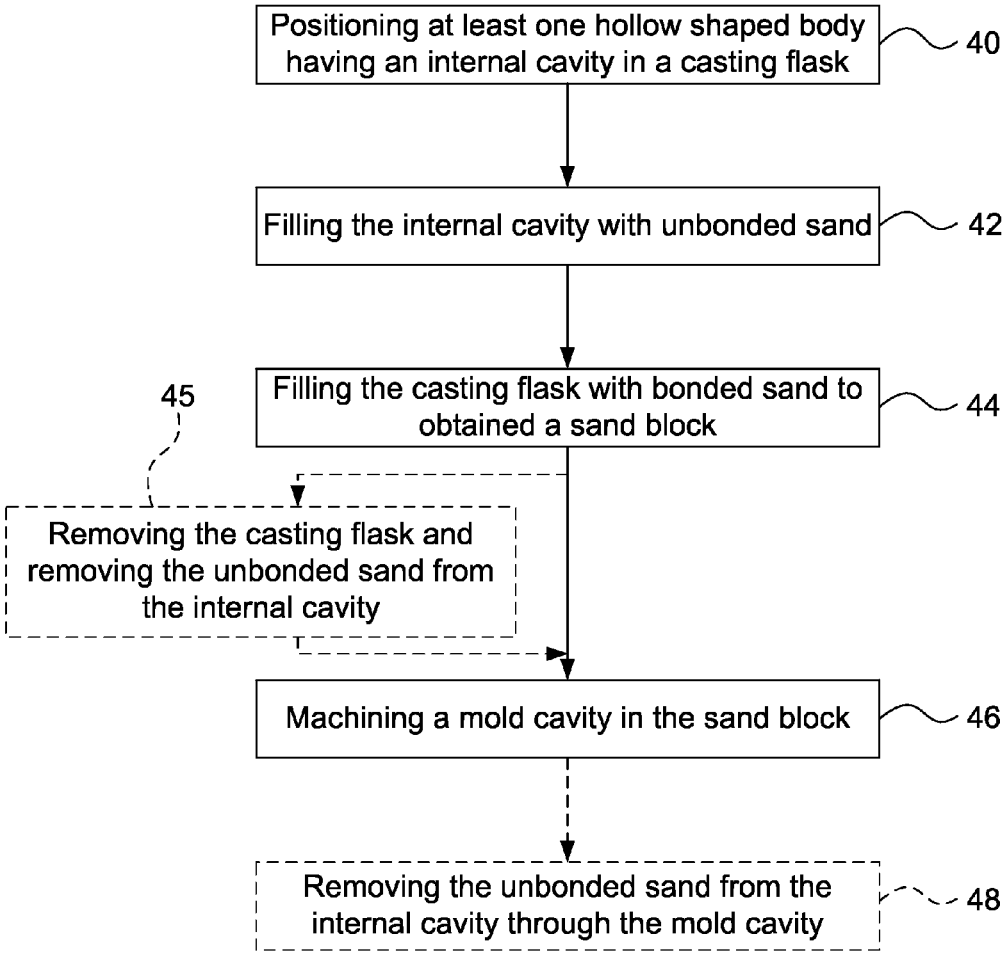
FIG. 4 is a flowchart showing various ste
for manufacturing the molding element shown in FIG. 1 in accordance with an embodiment.

Referring to FIG. 4, there is summarized a method for manufacturing secondary cavities such as risers 28 which are located behind the main mold cavity(ies) 26 or cannot be machined from the top side 22 of the molding element 20 without moving the latter during the machining step. Typically the volume of each one of the secondary cavities 28, such as the risers, is smaller than the volume of the main mold cavity 26 or the total volume of the mold cavities.

To create the secondary cavities 28, hollow shaped bodies 32 such as hollow shaped cylinders (or tubular bodies) made of a substantially rigid external material and defining an internal cavity are provided and positioned in a predetermined position on a molding board 34, such as a plywood board, and within a casting flask 33 (FIG. 3), i.e. the frame that surrounds the sand block 36 when forming same (step 40). The positions of the hollow shaped bodies 32 correspond to the position of the resulting secondary cavities in the molding element 20, as it will be described in more details below. In an embodiment, the hollow shaped bodies 32 have two opposed open ends, i.e. the ends of the internal cavity are opened and granular material inserted in the cavity can flow freely through both ends. However, in a non-limitative alternative embodiment, one end of the internal cavity can be a closed end.

In the embodiment shown in FIGS. 1 and 2, the hollow shaped bodies are tubular cylinders with two open ends through which granular material can flow. They can be made of an insulating material such as ceramic fiber to maintain the molten metal located in the internal cavity hot for longer time periods. In a particular embodiment, the hollow shaped bodies are made of an exothermic ceramic fiber. In an embodiment, ceramic fiber sleeves can be used to conceive the risers of a casting mold. However, one skilled in the art will appreciate that other materials can be used such as and without being limitative cardboard.

The internal cavities 34 of the hollow shaped bodies 32 are filled with unbonded sand (or free-flowing sand), i.e. sand that is substantially free of active binder material (step 42).

In an alternative and non-limitative embodiment, the hollow shaped bodies 32 are positioned in the casting flask 33 with their internal cavity 34 prefilled with unbonded sand. In other words, the filling step is performed before the insertion of the hollow shaped bodies 32 in the casting flask 33. One skilled in the art will appreciate that the hollow shaped bodies 32 can be filled with outer suitable flowable particular or granular material.

The hollow shaped bodies used to design risers can be used with knock-off cores (or neck downs). Knock-off cores are thin cores or tiles used to restrict the riser neck for making it easier to break or cut off the riser from the resulting casting. The knock-off cores (not shown) are superposed to the hollow shaped bodies with their apertures aligned with an open end of a respective one of the hollow shaped bodies 32 and its internal cavity. The apertures of the knock-off cores are also filled with flowable granular material such as unbonded sand.

When the internal cavities of the hollow shaped bodies 32 and the knock-off cores, if any, are filled with flowable granular material such as unbonded sand, the remaining volume of the casting flask 33, defining the sand block 36 of the molding element 20, is filled with bonded sand, i.e. sand including at least one active binder material (step 44).

Then, the casting flask 33 is removed from around the sand block 36 and the sand block 36 is positioned in a single, predetermined, and fixed position in an automated cell for machining the mold cavity 26 (step 45) or the mold cavities. In an embodiment, the internal cavities of the hollow shaped bodies 32 and the knock-off cores, if any, are emptied from unbonded sand when the casting flask 33 is removed from around the sand block 36 and the sand block 36 is raised from the molding board 34 (step 45). The unbounded sand can flow outwardly of the internal cavities through a lower end of hollow shaped bodies 32, i.e. through the bottom side 24 of the molding element 20.

In an alternative embodiment, the internal cavities of the hollow shaped bodies 32 and the knock-off cores, if any, are emptied from unbonded sand following the mold cavity machining step. In this alternative embodiment, the unbonded sand flows outwardly of the molding element 20 through the runners 30 and the mold cavity 26 (step 48). As mentioned above, the mold cavity 26 and the internal cavity of the hollow shaped bodies 32 are in fluid communication. Thus, flowable material contained in the internal cavity can flow through the mold cavity 26.

For instance and without being limitative, in the automated cell, a pre-programmed robot 38 (FIG. 3) carrying a cutting head, or any other machining tool carrying a cutting head, machines the mold cavity 26 in the sand block (step 46). Once the mold cavity 26 is machined, the molding element 20 is removed from the automated cell and is placed with the top side downwardly oriented. Unbonded sand located in the internal cavities of the hollow shaped bodies 32 freely flows out of the internal cavities of the hollow shaped bodies 32 and the mold cavity 26 (step 48).

Removal of the unbonded sand defines the secondary cavities 28 in the molding element 20 which are located behind the main mold cavity 26 but that have been created without moving, displacing or returning the sand block 36 during the machining step. Thus, the internal cavities of the hollow shaped bodies 32 correspond to the secondary cavities 28 of the molding element 20 when emptied of unbonded sand.

Following removal of the unbonded sand, the hollow shaped bodies 32 and the knock-off cores, if any, remain in the molding element 20. In an alternative embodiment and if accessible from the bottom side 24 of the molding element 20, they can be removed, for instance manually, following removal of unbonded sand.

In the embodiment shown in FIGS. 1 and 2, unbonded sand located in the internal cavities of the hollow shaped bodies 32 flows out of the internal cavities when removing the casting flask 33 and displacing the sand block 36 (step 45). The secondary cavities are thus formed without requiring a machining step.

It is appreciated that modifications can be made to the above-described method. For instance and without being limitative, the casting flask 33 can surround the sand block 36 during the mold cavity machining and be removed following the machining step as shown in FIG. 3.

Furthermore, in an alternative embodiment, a layer of bonded sand of variable thickness can be inserted in the casting flask before positioning the hollow shaped bodies 32 in their predetermined positions in the casting flask 33.

Furthermore, the tubular hollow shaped body 32 can have more than one internal cavity wherein the cavities are separated by a partition wall.

It is appreciated that the above-described method can be used to manufacture copes, drags or any other suitable molding elements.

As mentioned above, often the resulting casting includes an internal cavity. To create the internal cavity of the resulting casting, molding cores 50, which are inserted in predetermined positions in the hollow internal compartment of the aggregate material molds, are required. The molding core 50 defines the shape of the internal cavity of the casting during molten metal filling by preventing flowing material from occupying the core space. Thus, void space between molding core and mold cavity surface is what eventually becomes the casting and the molding core defines interior surfaces of the casting.

Referring to FIGS. 5 to 10, there is described a method for manufacturing molding cores 50 which are insertable in the hollow internal compartments defined in aggregate material molds. As mentioned above, the aggregate material mold can be formed by juxtaposing two or more molding elements, for instance a cope and a drag.

In the manufacturing method, there is first provided a permanent base member 72 (FIG. 3) which can be rotatable. In FIG. 3, the permanent base member 72 is part of the work cell 35 and is rotatable as it will be described in more details below.

Figure 5:
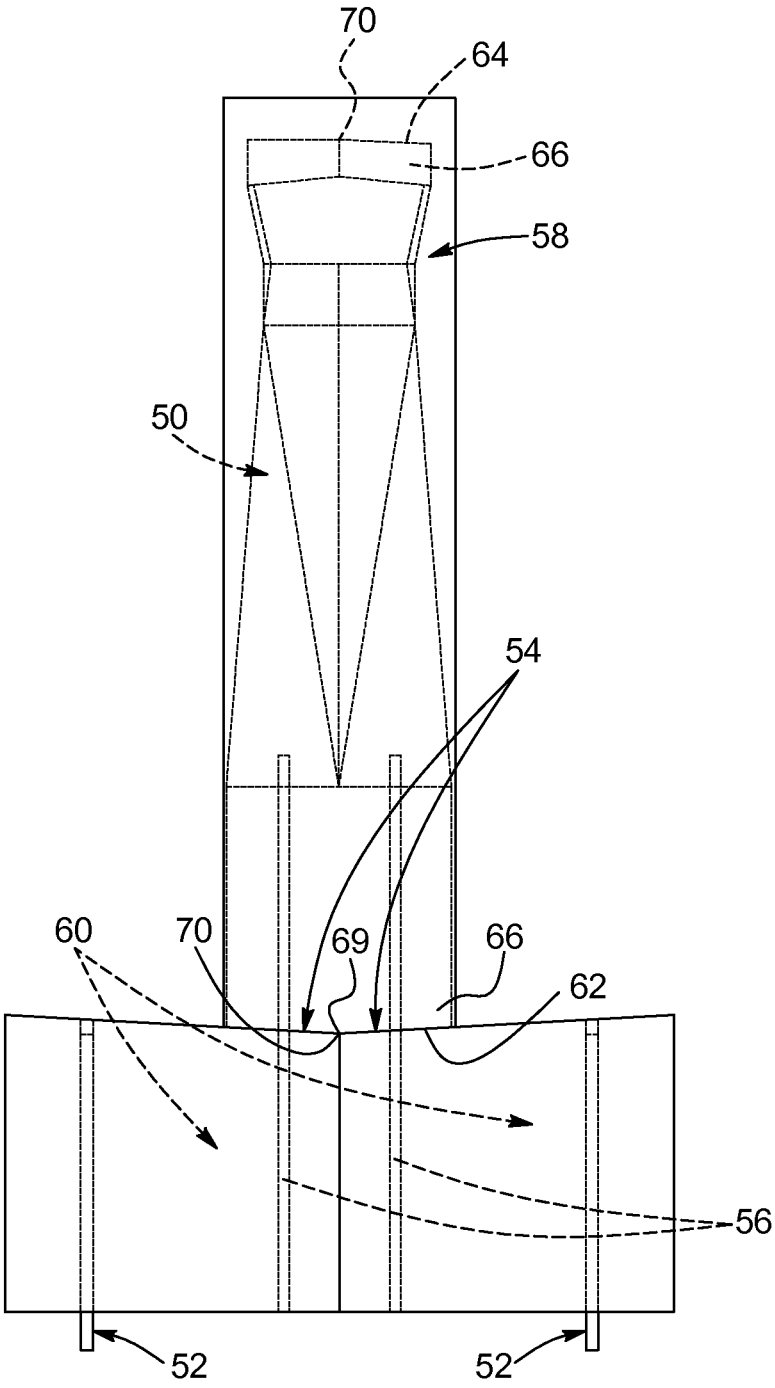
FIG. 5 is a schematic elevation view of a core base member in accordance with an embodiment with a core aggregate material block mounted thereto.
Figure 6:
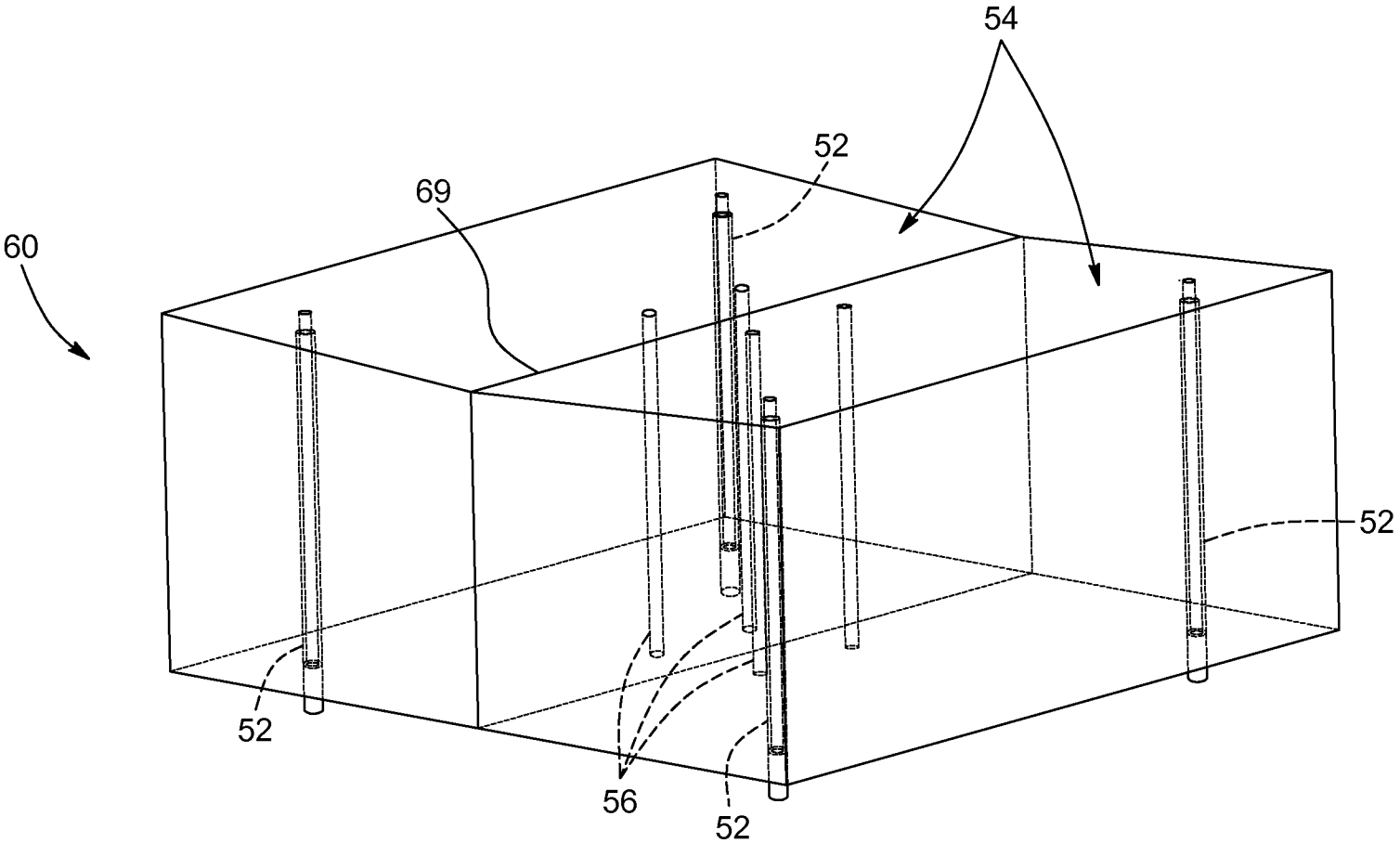
FIG. 6 is a schematic perspective view of the core base member shown in FIG. 5.

Referring now to FIGS. 5 and 6, there is shown that locating pins 52 extend upwardly from an upper surface 73 of the permanent base member 72. A first casting flask (not shown) is mounted to the upper surface 73 of the permanent base member 72 with the locating pins 52 positioned in the outer corners of the first casting flask. The locating pins 52 are aids for the positioning of the first casting flask above the permanent base member 72. The first casting flask defines an inwardly inclined upper surface and, more particularly, V-shaped concave upper profile when filled with bonded casting sand or other aggregate materials.

Retaining pins 56 for a core sand block 58 are inserted in the first casting flask. In the embodiment shown, the retaining pins 56 extend through the first casting flask and above its V-shaped concave upper profile.

Then, the first casting flask is filled with bonded sand to obtain a core base member 60 therein. The core base member 60 has a V-shaped concave upper surface 54 which corresponds to the V-shaped concave upper profile of the first casting flask. The V-shaped concave upper surface 54 is defined by two inwardly inclined planar surfaces that meet along a lengthwise-extending contact edge 69. Once the sand is bonded together, the first casting flask can be removed, leaving the core base member 60 with a V-shaped concave upper surface 54, step 80 of FIG. 7. As it will be described in more details below, retaining pins 58 are provided to secure the molding core sand block 58 to the core base member 60 and prevent displacement of the core sand block 58 relatively to the core base member 60 during the core machining step.

It is appreciated that the locating pins 52 and the retaining pins 56 can differ from the ones described above. One skilled in the art will appreciate that other features can be used to locate and retain the core forming components. Furthermore, their positions, shapes, and configurations can vary from the above-described embodiment.

In a non-limitative alternative embodiment, the core base member 60 can be formed with two first casting flasks, each having an inclined upper surface. Their lower sections are juxtaposed to one another to define the V-shaped concave upper surface 54 when filled with bonded casting sand. When the first casting flasks are removed, the inner juxtaposed faces of the two core base member sections are joined together with an appropriate casting sand adhesive to define the core base member 60 with the V-shaped concave upper surface 54 (step 80). In an alternative embodiment, the juxtaposed inner faces of the first casting flasks can also be secured to one another by any appropriate method and can surround the core base member 60 during the core machining step.

In another non-limitative alternative embodiment, the upper surface of the resulting core base member 60 can be concave but not compulsorily V-shaped. In a non limitative embodiment, the upper surface of the resulting core base member 60 can be concave and U-shaped.

Furthermore, in an alternative embodiment, only the upper layer of the core base member 60 can include a friable material such as an aggregate material.

Figure 7:
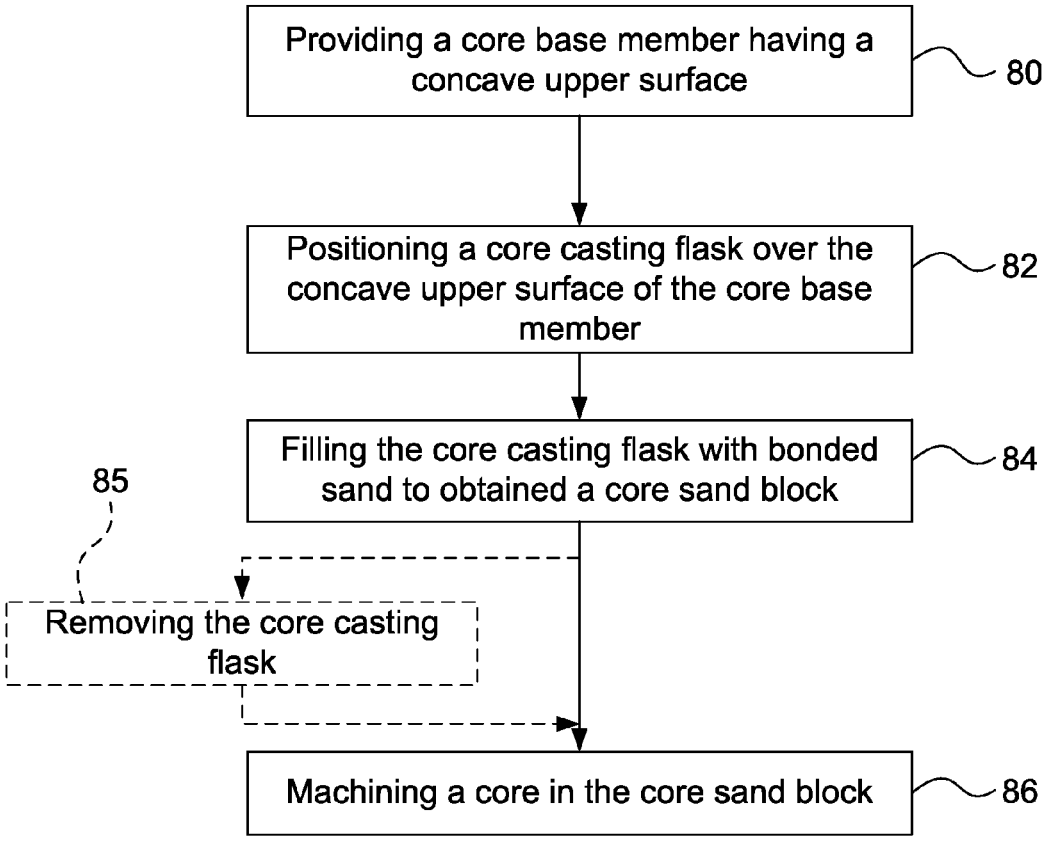
FIG. 7 is a flowchart showing various steps for manufacturing a molding core with the core base member shown in FIGS. 5 and 6 in accordance with an embodiment.

Subsequently, a core casting flask (not shown) is mounted above the V-shaped concave upper surface 54 of the core base member 60 with the retaining pins 56 extending upwardly in the core casting flask (step 82 of FIG. 7). The core casting flask is then filled with bonded sand (step 84) or any other suitable aggregate material. Once the sand is bonded together, the core casting flask is removed, leaving a core sand block 58 over the V-shaped concave upper surface 54 of the core base member 60 (step 85). As mentioned above, the retaining pins 56 secure the core sand block 58 in a predetermined and fixed position over the core base member 60.

The resulting core sand block 58 has a V-shaped convex lower surface 62. It is appreciated that the lower surface of the core sand block 58 is a complementary convex surface to the concave upper surface of the core base member 60. Thus, in the embodiment shown, the core sand block 58 has two inwardly inclined substantially flat surfaces that meet along a lengthwise-extending contact edge 70 (or ridge) which is in register with the contact edge 69 of the core base member 60.

Then, a pre-programmed robot carrying a cutting head, or any other machining tool carrying a cutting head, machines the molding core 50 in the core sand block 58 (step 86). Once the molding core 50 is machined, the machined core 50 is removed from the automated cell and can be used in foundry molds to create internal cavities and castings. For instance, the molding core 50 can be inserted in a mold cavity 26 defined in a corresponding molding element, for instance defined in a cope or in a drag, as defined above. The other molding element(s) is(are) juxtaposed to the molding element having the molding core 50 inserted therein to define the hollow internal compartment. It is appreciated that the sand mold can include one or more molding elements.

In the embodiment shown in FIG. 3, the same work cell 35 with the same machine tool 35 are used to machine the molding elements 20 such as the cope and the drag of a mold as well as the molding core 50 insertable in-between. However, one skilled in the art will appreciate that in an alternative and non-limitative embodiment, the molding elements 20 such as the cope and the drag of a mold and the molding core 50 can be machined in different work cells.

Due to the V-shaped concave upper surface 54 of the core base member 60, the resulting molding core 50 has a V-shaped convex lower surface, as mentioned above. Furthermore, the core sand block 58 can be machined to have a corresponding V-shaped convex upper surface 64, as shown in FIGS. 5 and 6. The V-shaped convex lower and upper surfaces 62, 64 facilitate the insertion of the molding core 50 in the molding elements 20 defining the sand casting mold, as it will be described in more details below.

In the embodiment described above, the core base member 60 is made of bonded sand. However, it is appreciated that in an alternative embodiment, the core base member 60 can be made of any other appropriate material. It can also be made of a combination of different materials. In an embodiment, the upper layer of the core base member 60, i.e. the layer defining the V-shaped concave upper surface 54, is made of a friable or a malleable material in a manner such that the machining tool can be in contact with the upper surface 54 for machining the molding core 50 without incurring permanent damage or premature wearing.

Figure 8:
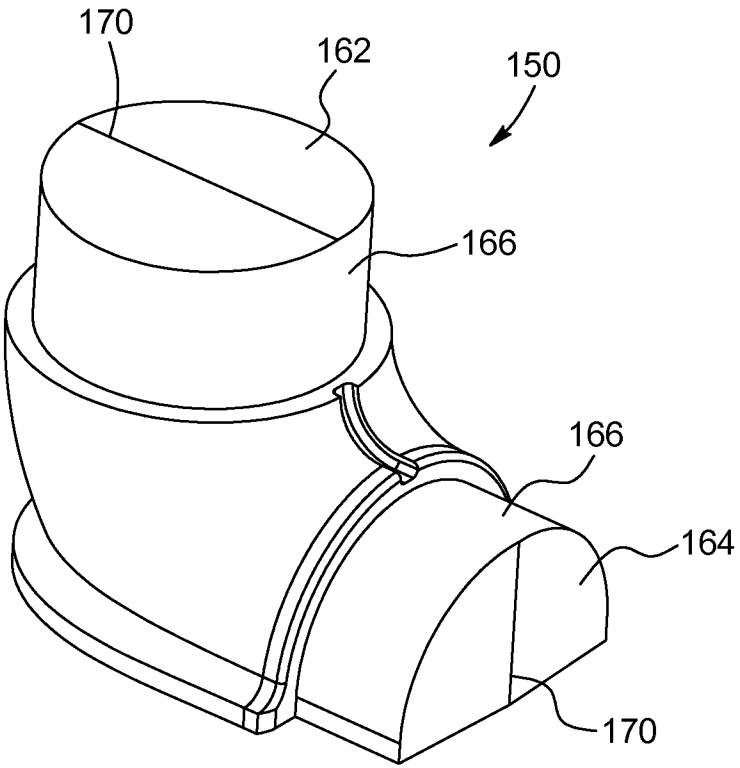
FIG. 8 is a perspective view of a molding core, in accordance with another embodiment, manufactured with the core base member shown in FIG. 5.

Referring now to FIG. 8, there is shown an alternative embodiment of an aggregate material molding core 150 formed with the above-described method wherein the features are numbered with reference numerals in the 100 series which correspond to the reference numerals of the previous embodiment. In the embodiment shown in FIG. 8, the V-shaped concave surfaces 162, 164 of the aggregate material molding core 150 are not facing one another, i.e. the V-shaped concave lower surface 162 is substantially orthogonal to the V-shaped concave upper surface 164. Thus, one skilled in the art will appreciate that the shape and the configuration of the aggregate material molding core 50, 150 can vary from the illustrated embodiments. The V-shaped concave surfaces are end surfaces of the core. Furthermore, the aggregate material molding core 50, 150 can include one or more V-shaped convex surfaces.

Figure 10:
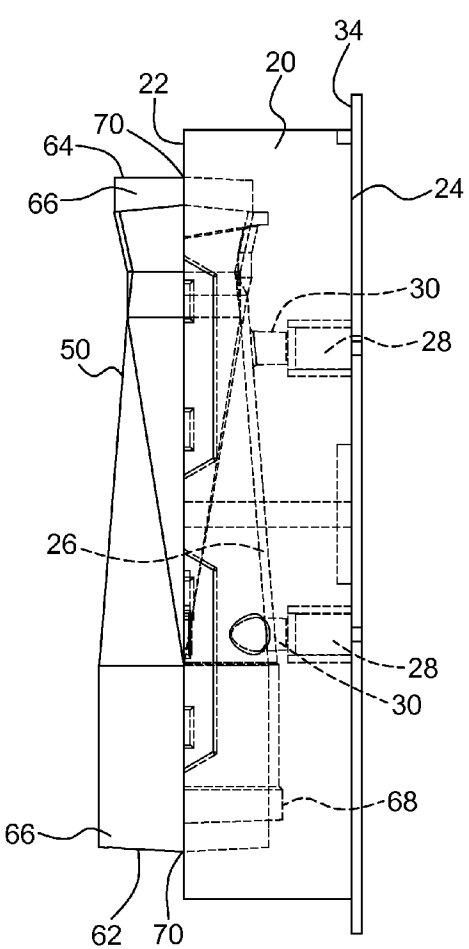
FIG. 10 is a top plan view of the molding element and the molding core inserted therein shown in FIG. 9.
Figure 9:
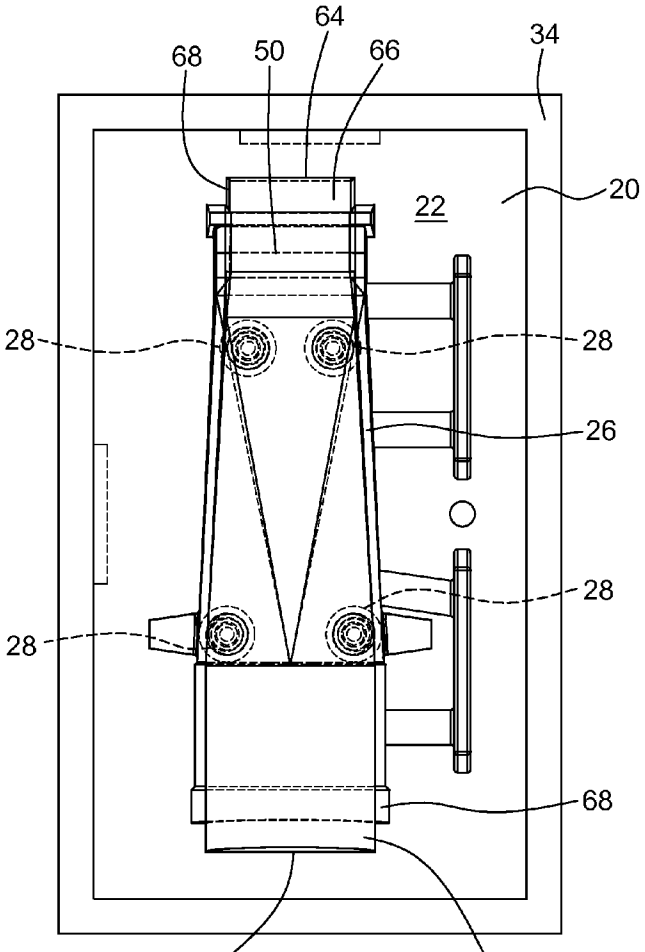
FIG. 9 is an elevation view of the molding element shown in FIG. 1 with a molding core inserted therein.

In an embodiment, the V-shaped convex lower and upper surfaces 62, 64 are located on the core prints 66 of the molding core 50, i.e. projections extending from the molding core 50 that are designed to position and hold the molding core 50 in the mold cavities 26 of the molding elements 20. The core prints 66 are shaped to mate with conforming pockets 68 defined in the mold cavities 26 of the molding elements 20 as shown in FIGS. 9 and 10.

To facilitate the insertion of the molding core 50 in the mold cavities 26, the molding core 50 is inserted in a first mold cavity 26 with the core prints 66 in register with the pockets 68 defined in the mold cavity 26. The lower and upper surfaces 62, 64 being V-shaped, the molding core 50 is oriented in a manner such that the contact edge 70 of the lower and upper surfaces 62, 64 is parallel to the top side 22 of the molding element 20. Therefore, shorter sections of the molding core 50 are inserted deeper in the mold cavity 26. In the sand mold, the contact edges 70 of the molding core 50 are substantially in the same plane than the juxtaposed top sides 22 of the molding elements 20.

Without the V-shaped concave upper surface 54 of the core base member 60, it would not be possible to machine the molding core 50 with two opposed V-shaped lower and upper surfaces 62, 64 without moving the core sand block 58 during the core machining step. By forming and sitting the core sand block 58 on the V-shaped concave upper surface 54 of the core base member 60, the lower surface 62 of the molding core 50 is pre-shaped into the desired V-shaped lower surface 62.

As mentioned above, the permanent base member 72 can be rotatable, or for machining the molding core 50, the core sand block 58 can be mounted to a rotatable base (not shown). Thus, during the core machining step, the base member can rotate. Simultaneously, the core sand block 58, which is mounted to the base member, can rotate simultaneously. The robot or any other machining tool can machine the core sand block 58 without moving or displacing the molding core 50 on the base member. By rotating the core sand block 58, the robot is successively facing each face of the core sand block 58.

In an embodiment, the base member can rotate continuously and the machine tool 38, which is synchronized with the base member rotation, machines the core block while the core block rotates. In an alternative embodiment, the rotation of the base member can be discontinuous and the machine tool 38 machines the core block between rotation steps and/or during rotation steps.

In an embodiment, more than one complete rotation of the base member and the core block, i.e. more than 360°, can be performed for machining the core block. In an alternative embodiment, the molding core can be machined in a single rotation, i.e. 360°, or less than a single rotation.

The rotation of the permanent base member 72 and consequently rotation of the core sand block 58 can be controlled by the robot controller or the machine tool control system. Therefore, the rotation of the core sand block 58 is synchronized with the machining robot 38.

Several alternative embodiments and examples have been described and illustrated herein. The embodiments of the invention described above are intended to be exemplary only. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind without significantly departing from the spirit of the invention. The scope of the invention is therefore intended to be limited solely by the scope of the appended claims.

The invention claimed is:

1. A method for forming a molding element, comprising:

inserting at least one hollow center body defining an internal cavity in a predetermined position in a casting flask, the internal cavity being filled with flowable granular material;

filling the casting flask with bonded granular material to obtain a granular material block; and substantially emptying the internal cavity of the at least one hollow center body from the flowable granular material.

2. A method as claimed in claim 1, wherein the internal cavity of the hollow center body is filled with the flowable granular material following the insertion of the at least one hollow center body in the casting flask.

3. A method as claimed in claim 1, further comprising machining a mold cavity in a top side of the granular material block.

4. A method as claimed in claim 3, wherein said machining is carried prior to said emptying the internal cavity and said emptying the internal cavity comprises emptying the internal cavity through the mold cavity.

5. A method as claimed in claim 3, wherein said machining is carried following said emptying the internal cavity.

6. A method as claimed in claim 3, wherein said machining comprises maintaining the granular material block in a stationary configuration.

7. A method as claimed in claim 3, wherein the granular material block comprises a bottom side, opposed to the top side, wherein the mold cavity comprises a recess defined in the top side of the granular material block and the at least one hollow center body is positioned close to the bottom side of the granular material block and the internal cavity is in fluid communication with the mold cavity.

8. A method as claimed in claim 3, wherein the internal cavity has an internal cavity volume and the mold cavity has a mold cavity volume, the internal cavity volume being smaller than the mold cavity volume.

9. A method as claimed in claim 1, further comprising providing a first layer of bonded granular material in the casting flask before inserting the at least one hollow center body in the casting flask and wherein said inserting comprises positioning the at least one hollow center body on the first layer of the bonded granular material.

10. A method as claimed in claim 1, wherein said inserting comprises positioning the at least one hollow center body directly on a molding board and said emptying comprises emptying the internal cavity through an open end of the at least one hollow center body aligned with a bottom side of the granular material block.

11. A method as claimed in claim 1, wherein the internal cavity defines a riser of the molding element.

12. A method as claimed in claim 1, wherein the at least one hollow center body comprises a rigid tubular shell and the internal cavity is open at both ends.

13. A method as claimed in claim 12, wherein the rigid tubular shell comprises a ceramic fiber sleeve.

14. A method as claimed in claim 12, wherein the rigid tubular shell comprises a heat insulating material.

15. A method as claimed in claim 1, wherein the granular material of the internal cavity comprises unbonded sand and the bonded granular material comprises bonded sand.

16. A molding element comprising:

an aggregate material body comprising bonded sand having a top side, a bottom side, opposed to the top side, and a mold cavity defining a recess in the top side; and at least one hollow center body embedded in the aggregate material body in a predetermined position and defining an internal cavity in fluid communication with the mold cavity, the internal cavity being filled with flowable granular material.

17. A molding element as claimed in claim 16, wherein the flowable granular material comprises unbonded sand.

18. A molding element as claimed in claim 16, further comprising a casting flask surrounding the aggregate material body.

19. A molding element as claimed in claim 16, wherein the internal cavity has an internal cavity volume and the mold cavity has a mold cavity volume, the internal cavity volume being smaller than the mold cavity volume.

20. A molding element as claimed in claim 16, wherein the at least one hollow center body comprises a rigid tubular shell and the internal cavity is open at both ends and one of the open ends of the internal cavity is exposed on the bottom side of the aggregate material body.

21. A molding element as claimed in claim 20, wherein the rigid tubular shell comprises a ceramic fiber sleeve.

22. A molding element as claimed in claim 20, wherein the rigid tubular shell comprises a heat insulating material.

23. A molding element as claimed in claim 16, wherein the at least one hollow center body comprises a rigid tubular shell and the internal cavity is open at both ends and one of the open end is covered by a layer of the aggregate material body.

24. A molding element as claimed in claim 16, wherein the internal cavity defines a riser of the molding element.

* * * * *